US006398571B1

(12) United States Patent
Nishide et al.

(10) Patent No.: US 6,398,571 B1
(45) Date of Patent: Jun. 4, 2002

(54) WATERPROOF INSULATION DISPLACEMENT CONNECTOR AND METHOD OF MANUFACTURING IT

(75) Inventors: Satoru Nishide; Hajime Kawase; Ryotaro Ishikawa, all of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/440,719

(22) Filed: Nov. 16, 1999

(30) Foreign Application Priority Data

Feb. 23, 1999 (JP) ..... 11-045304

(51) Int. Cl.[7] ..... H01R 13/52; H01R 13/40; H01R 13/502; H01R 13/514

(52) U.S. Cl. ..... 439/275; 439/587; 439/701

(58) Field of Search ..... 439/587, 404, 439/405, 417, 274, 275, 701, 449, 452, 456, 459, 406, 407, 397, 398, 399

(56) References Cited

U.S. PATENT DOCUMENTS 3,858,160 A * 12/1974 Denton ..... 174/135
5,299,949 A * 4/1994 Fortin ..... 439/275
5,314,352 A * 5/1994 Halbinger et al. ..... 174/65 R
5,520,550 A * 5/1996 Okabe ..... 439/404
5,707,251 A * 1/1998 Sakai et al. ..... 439/589
5,762,524 A 6/1998 Ford et al.
6,033,261 A * 3/2000 Wakata et al. ..... 439/587
6,053,753 A * 4/2000 Kunkle ..... 439/275
6,071,147 A * 6/2000 Tsukamoto ..... 439/587
6,095,859 A * 8/2000 Maeda ..... 439/587
6,102,740 A * 8/2000 Murakami et al. ..... 439/598
6,174,201 B1 * 8/2000 Murakami ..... 439/598
6,152,752 A * 11/2000 Fukuda ..... 439/275
6,186,821 B1 * 2/2001 Mullen, Jr. ..... 439/399

* cited by examiner

*Primary Examiner*—P. Austin Bradley
*Assistant Examiner*—Edwin A. León
(74) *Attorney, Agent, or Firm*—Oliff & Berridge, PLC

(57) ABSTRACT

A rubber stopper is provided at a rear end of a housing. A receiving tool-insertion opening is formed on a bottom surface of a cavity of the housing such that the receiving tool-insertion opening is located immediately forward from the rubber stopper. A receiving portion is projectingly formed on a lower part of a pressure die. When the housing accommodating a pressure-connection terminal is placed on the lower part, the receiving portion projects upward through the receiving tool-insertion opening, and the apex of a mountain portion is located in the vicinity of an insertion hole of the rubber stopper. When a pressure tool installed on an upper part of the pressure die moves downward, a front end of an electric wire is pressed against and connected with a pressure blade. As a result, the electric wire projecting from the rubber stopper is stretched downward. In this case, a root portion of the electric wire is received with the receiving portion. Thus, the insertion hole of the rubber stopper is not subjected to the stretching force. Consequently, the insertion hole can be prevented from deforming, which provides sealing performance in the periphery of the electric wire securely.

7 Claims, 9 Drawing Sheets

WATERPROOF INSULATION DISPLACEMENT CONNECTOR AND METHOD OF MANUFACTURING IT

BACKGROUND OF THE INVENTION

1. Field of Invention

The present invention relates to a waterproof insulation displacement connector and a method of manufacturing it.

2. Description of Related Art

A waterproof insulation displacement connector of this kind is disclosed in Patent Application Laid-Open No. 9-92384. Briefly describing it, a rubber stopper into which electric wires are inserted watertightly is formed on the rear surface of the housing accommodating a plurality of pressure-connection terminals connected with electric wires under pressure. The housing is accommodated in the accommodating hole formed on the frame, and the entrance of the accommodating hole is closed with the rubber stopper.

The construction of the housing arid the process of connecting the electric wires with the terminals under pressure will be described below.

As shown in FIG. 9, a plurality of cavities (d) each accommodating a pressure-connection terminal (c) having a pressure blade (b) is formed in a housing (a) such that the cavities (d) are arranged in parallel with one another. An opening (e) is formed on an upper surface of each cavity (d), and a rubber stopper (f) for all the cavities (d) is provided on a rear surface of the housing (a). A plurality of insertion holes (g) into each of which an electric wire (h) can be inserted watertightly is formed through the rubber stopper (f) such that each insertion hole (g) corresponds to each cavity (d). Each insertion hole (g) is formed at a position higher than the level of the pressure blade (b) of the terminal (c) so that the electric wire (h) can be inserted through the insertion hole (g) without the electric wire (h) interfering with the pressure blade (b).

In a pressure-connection work, the electric wire (h) is inserted straight into the insertion hole (g) of the rubber stopper (f). Then, an end of the electric wire (h) is held over the pressure blade (b). Then, the end of the electric wire (h) is inserted into the opening (e) and pressed downward to the pressure blade (b) with a pressure tool. As a result, the end of the electric wire (h) is connected with the terminal (c) under pressure, as shown with two-dot chain lines of FIG. 9.

However, in the above-described conventional waterproof insulation displacement connector, the insertion position of the electric wire (h) inside the rubber stopper (f) is higher than that of the pressure blade (b). Thus, when the electric wire (h) is connected with the terminal (c) under pressure, the portion of the electric wire (h) projecting forward from the insertion hole (g) of the rubber stopper (f) is bent and stretched downward. Consequently, the electric wire (h) compresses the lower side of the front end of the insertion hole (g), thus forming a gap between it and the upper side of the front end of the insertion hole (g). Thus, the sealing performance in the periphery of the electric wire (h) may deteriorate.

SUMMARY OF THE INVENTION

The present invention has been made in view of the above-described problem. Therefore, it is an object of the present invention to secure sealing performance in the periphery of an electric wire.

In order to solve the above-identified object, a rubber stopper having an insertion hole into which an electric wire can be inserted watertightly is provided on a rear surface of a housing accommodating a plurality of cavities each accommodating a pressure-connection terminal and having a pressure-connection opening formed on a surface thereof. The electric wire is inserted through the insertion hole of the rubber stopper to place a front end of the electric wire in the vicinity of a front end of the pressure-connection opening, and the front end of the electric wire is pressed against the pressure-connection terminal to connect the electric wire with the pressure-connection terminal. A receiving tool projecting in a direction opposite to a pressure-connection direction is provided immediately forward from the rubber stopper to connect the electric wire with the pressure-connection terminal, while the receiving tool is receiving a root portion of the electric wire projecting forward from the rubber stopper.

The receiving tool provided on a pressure die is inserted into the cavity at a position immediately forward from the rubber stopper in a direction opposite to the pressure-connection direction. A guide portion formed on the receiving tool moves forward the electric wire inserted through the rubber stopper while the guide portion guides the electric wire in a direction apart from the pressure-connection terminal.

A rubber stopper having an insertion hole into which an electric wire is inserted watertightly is provided on a rear surface of a housing accommodating a plurality of cavities each accommodating a pressure-connection terminal and having an pressure-connection opening formed on a surface thereof. The cavity has a receiving tool-insertion opening formed at a position of a surface thereof opposite to the surface on which the pressure-connection opening is formed to receive a root portion of the electric wire projecting forward from the rubber stopper such that the receiving tool-insertion opening is located immediately forward from the rubber stopper. A cover for closing the receiving tool-insertion opening is also provided.

A rubber stopper having an insertion hole into which an electric wire is inserted watertightly is provided on a rear surface of a housing accommodating a plurality of cavities each accommodating a pressure-connection terminal and having an opening formed on a surface thereof. A receiving tool for receiving a root portion of the electric wire projecting forward from the rubber stopper is projectingly formed at a position on the surface of the cavity opposite to the surface on which the pressure-connection opening is formed such that the receiving tool is located immediately forward from the rubber stopper.

A guide portion is formed on an end of the receiving tool to forward move the electric wire inserted through the rubber stopper while the guide portion is guiding the electric wire in a direction apart from the pressure-connection terminal.

An electric wire is inserted into the insertion hole of the rubber stopper, with the receiving tool provided immediately forward from the rubber stopper. Then the electric wire is pressed against the pressure-connection terminal. As a result, the electric wire is connected with the terminal under pressure, with the receiving tool receiving the root portion of the electric wire projecting forward from the rubber stopper.

When the electric wire is stretched in the pressure-connection direction in a pressure-connection operation, the root portion of the electric wire is received with the receiving portion. Thus, the insertion hole of the rubber stopper is not subjected to the stretching force. Consequently, the insertion hole of the rubber stopper can be prevented from deforming, which provides sealing performance in the periphery of the electric wire securely.

When the housing is placed on the pressure die, the receiving tool provided on the pressure die is inserted into the cavity at the position immediately forward from the rubber stopper.

An electric wire inserted through the rubber stopper is moved forward while it is being guided by the guide portion of the receiving tool in a direction apart from the pressure-connection terminal. Thus, even a deformed electric wire can be prevented from interfering with the pressure-connection terminal when it is moved forward in the cavity.

With the receiving tool-insertion opening formed on the housing, the method of process of the present invention can be carried out reliably. The opening also contains a cover which can be opened and closed.

The method of process of the present invention can be carried out without altering the construction of the pressure die. Similarly, it is possible to prevent an electric wire inserted into the cavity from interfering with the pressure-connection terminal without altering the construction of the pressure die.

DETAILED DESCRIPTION OF PREFERRED EMBODIMENTS

The embodiment of the present invention will be described below with reference to accompanied drawings.

A first embodiment of the present invention will be described below with reference to FIGS. 1 through 7.

Figure 1:
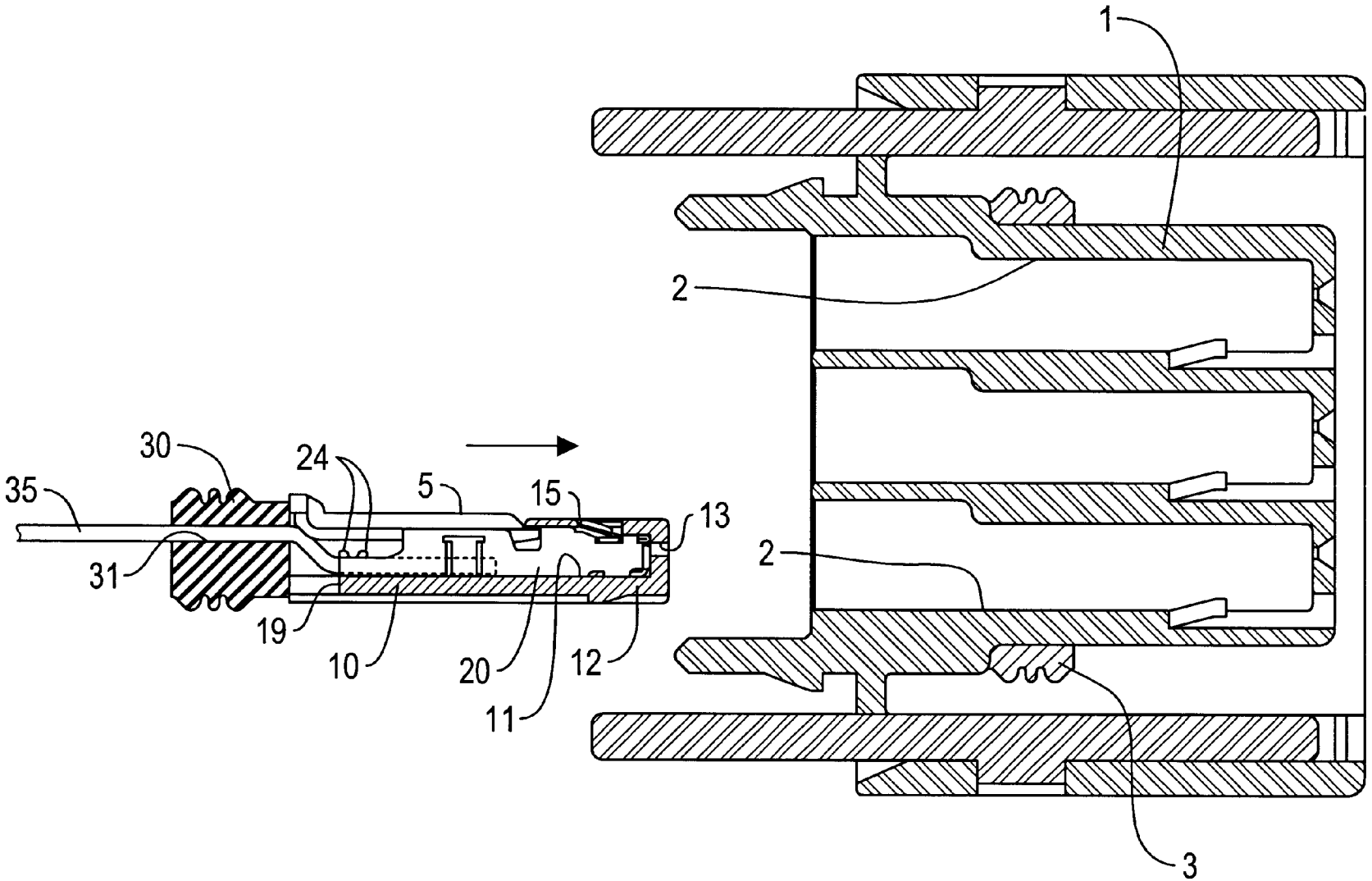
FIG. 1 is a sectional view showing a housing and a frame according to a first embodiment of the present invention.

In the first embodiment, a female-side waterproof connector is described. As shown in FIG. 1, a plurality of housing accommodation chambers 2 is formed inside a female-side frame 1. Each of the housing accommodation chambers 2 accommodates a housing 10 in which a female-side pressure-connection terminal (hereinafter referred to as merely terminal) 20 is installed. The frame 1 and a mating male-side frame (not shown) are watertightly fitted into each other through a seal ring 3.

Figure 2:
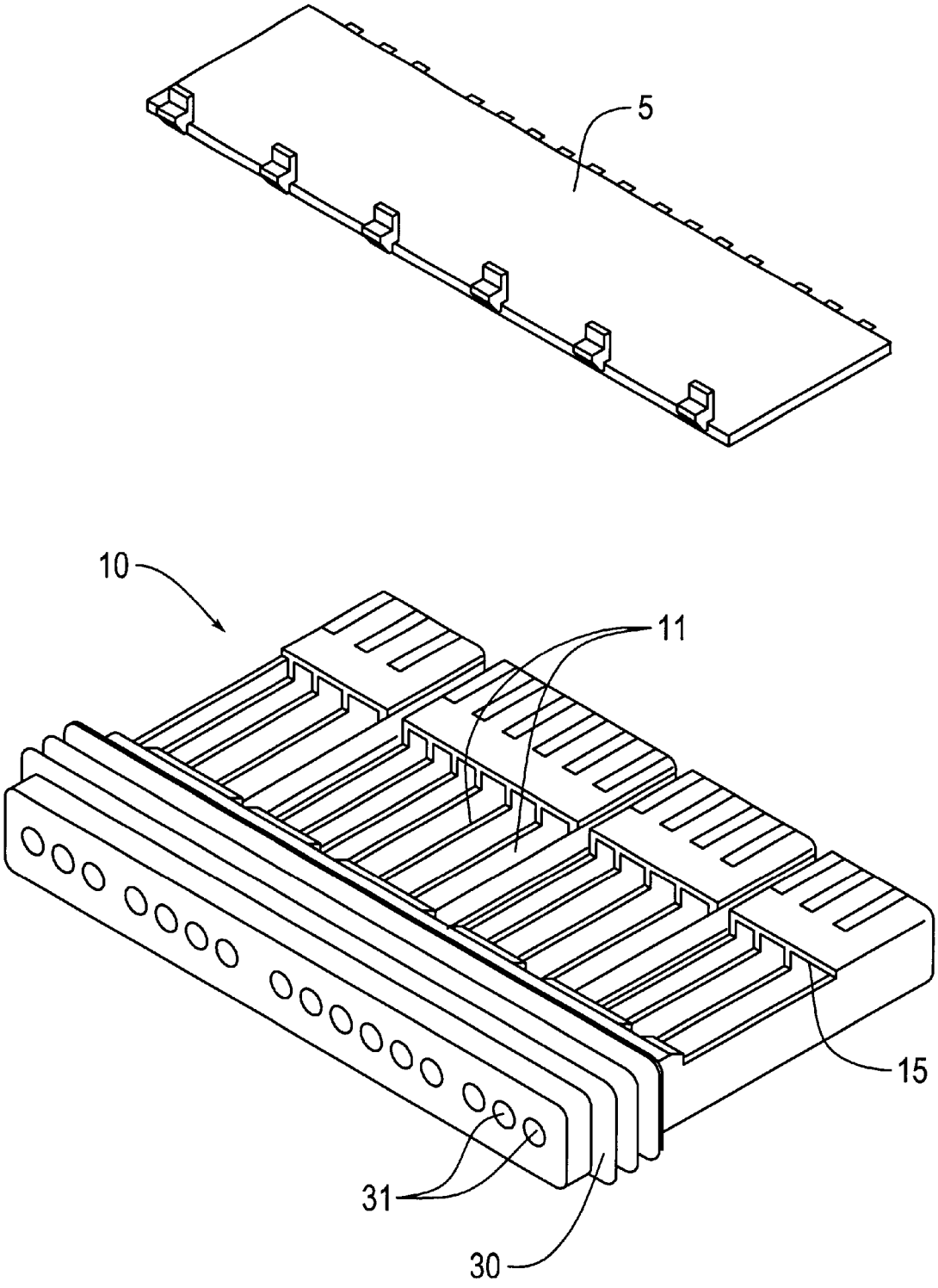
FIG. 2 is an exploded perspective view showing the housing shown in FIG. 1.
Figure 4:
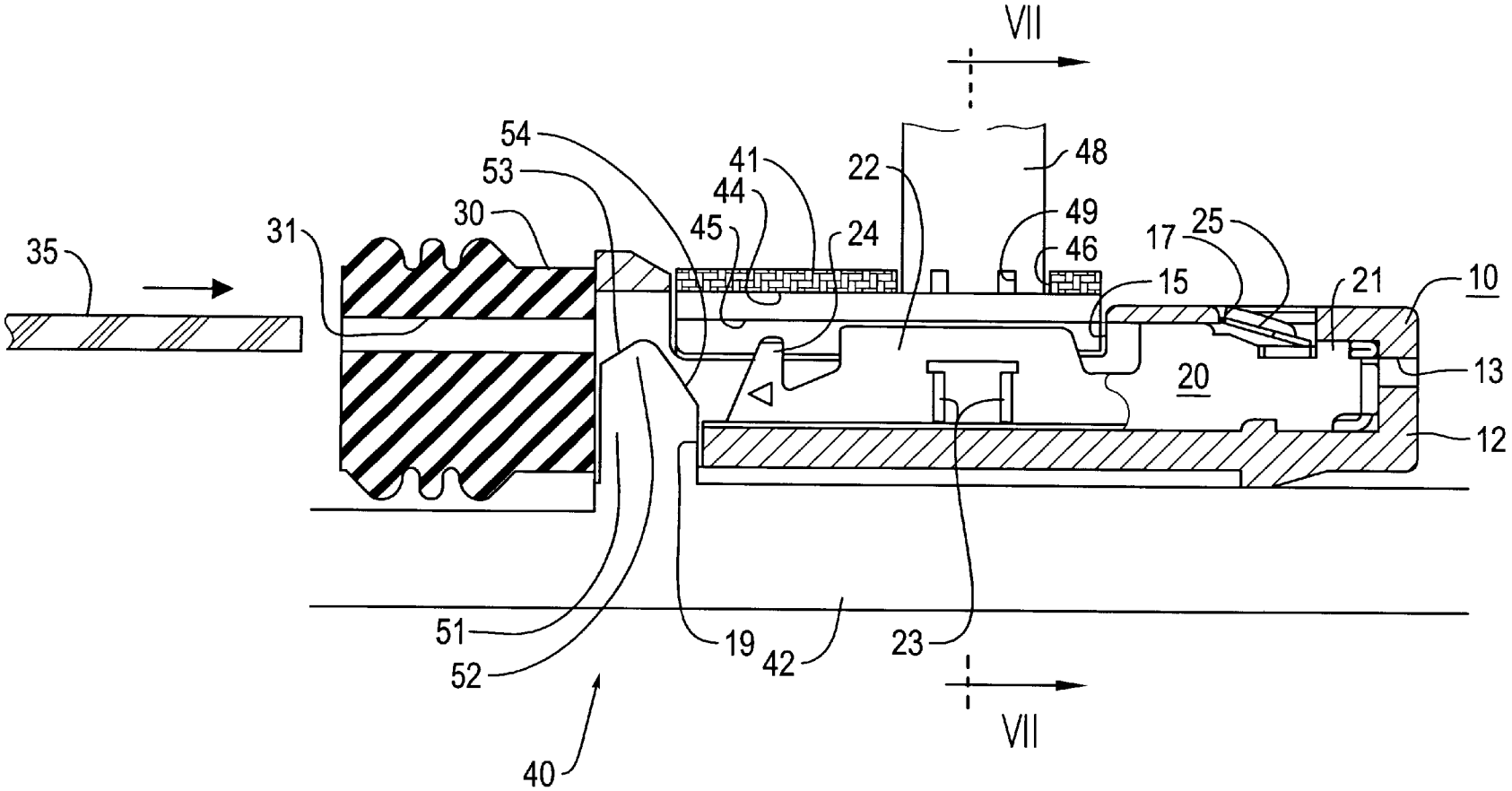
FIG. 4 is a sectional view showing a state before insertion of an electric wire is not carried out in a pressure-connection process.

The construction of the housing 10 will be described below. As shown in FIG. 2, the housing 10 has a shape of a rectangular solid. The housing 10 accommodates a plurality of cavities 11 arranged in parallel with one another. As shown in FIG. 4, each cavity 11 is open at its rear side and has a front plate 12 provided at its front side. The front plate 12 has a terminal insertion opening 13 formed therethrough to insert a tab of a mating male-side terminal (not shown) into the terminal insertion opening 13. The upper surface of the housing 10 is cut off over its whole width except a predetermined range at its front end (right side in FIG. 4) and except a very small range at its rear end. The upper surface of the housing 10 is formed as a pressure-connection opening 15 (hereinafter referred to as merely opening) into which an upper part 41 of a pressure die 40 which will be described later is inserted.

Figure 3:
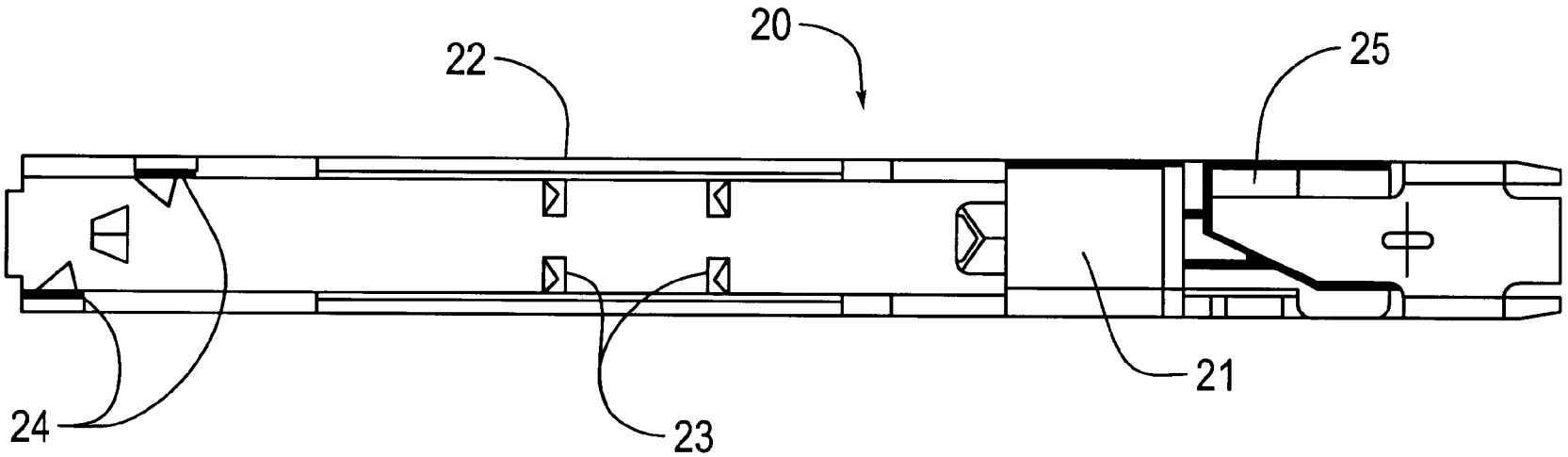
FIG. 3 is a plan view showing a pressure-connection terminal.
Figure 7:
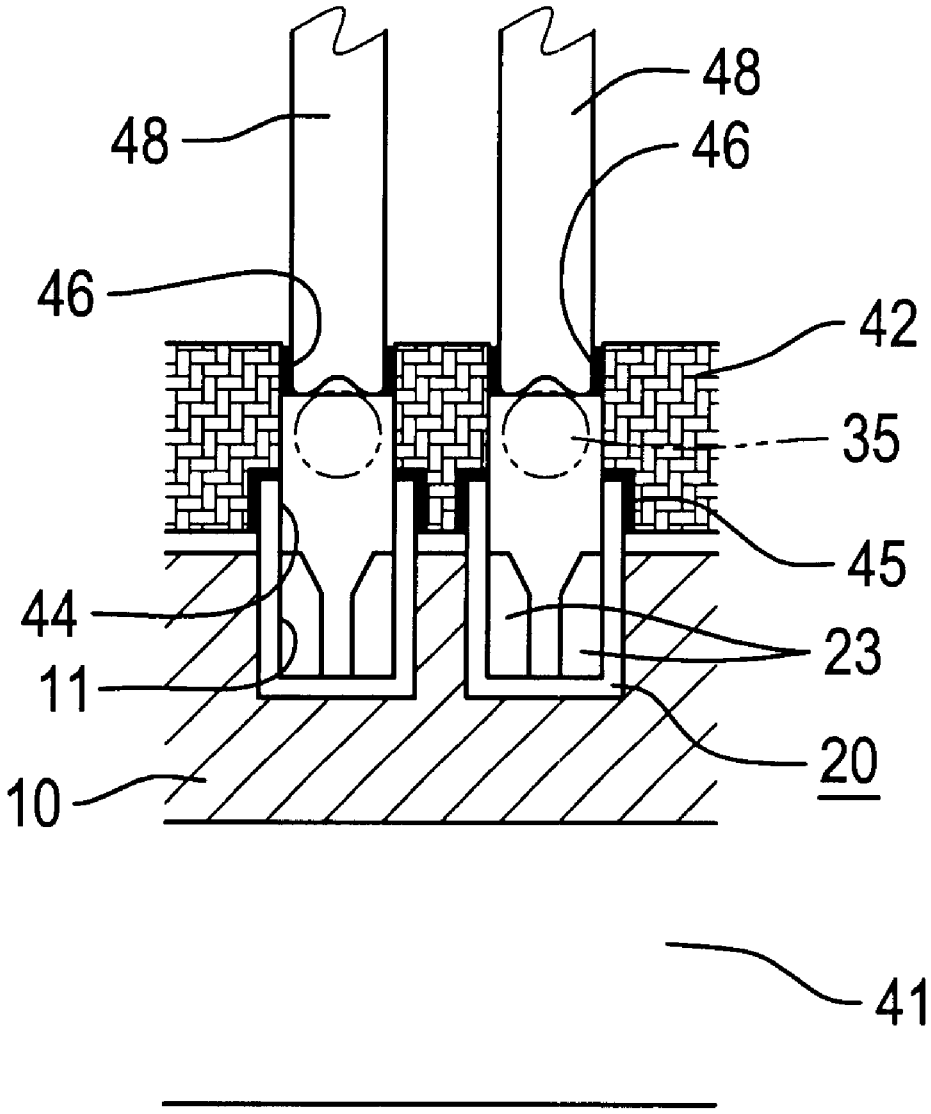
FIG. 7 is a sectional view taken along a line X—X of FIG. 4.

Each cavity 11 accommodates the terminal 20. As shown in FIGS. 3 and 4, the terminal 20 has a box-shaped connection portion 21 accommodating a connection piece at its front side and a groove-shaped pressure portion 22 positioned rearward from the connection portion 21 and open on its upper surface. As also shown in FIG. 7, the pressure portion 22 has a pair of front and rear pressure blades 23 formed thereon by cutting right and left walls thereof and raising the cut-off portions inward. A barrel 24 is formed rearward from the pressure portion 22.

As shown in FIG. 4, the terminal 20 is inserted into each cavity 11 from the rear side thereof When the terminal 20 is brought into contact with the front plate 12, its forward movement is stopped. A metal lance 25 formed on the upper surface of the connection portion 21 is fitted into a locking hole 17 formed on the ceiling surface of the cavity 11, thus preventing the terminal 20 from being removed rearward from the cavity 11.

A rubber stopper 30 for all the cavities 11 is installed on the housing 10 at the rear surface thereof. The rubber stopper 30 is large enough to cover the rear surfaces of all the cavities 11. The rubber stopper 30 can be installed tightly on the entrance of the housing accommodation chamber 2 of the frame 1. The rubber stopper 30 can be installed on the rear surface of the housing 10 through an installing means (not shown). The rubber stopper 30 has a plurality of insertion through-holes 31 (FIG. 2) at positions in correspondence to the respective cavities 11. An electric wire 35 is watertightly inserted into each cavity 11. As shown in FIG. 4, the level of the insertion through-hole 31 is higher than that of the pressure blade 23 such that the electric wire 35 inserted through the insertion through-hole 31 does not interfere with the pressure blade 23 of the terminal 20 accommodated in each cavity 11.

The pressure die 40 is provided to connect the electric wire 35 with the terminal 20 under pressure. As shown in FIG. 4, the pressure die 40 includes the upper part 41 and a lower part 42. The housing 10 can be placed on the lower part 42. The upper part 41 can be fitted into the opening 15 formed on the upper surface of the housing 10 and is vertically movable. The upper part 41 has a plurality of pressing concave portions 44 formed on its lower surface at positions in correspondence to the respective cavities 11. As shown in FIG. 7, each pressing concave portion 44 is formed on the lower surface of the upper part 41 of the pressure die 40 such that the center portion of the pressing concave portion 44 in its widthwise direction is raised to form right and left stepped portions 45. When the upper part 41 of the pressure die 40 moves downward to a predetermined position, the right and left stepped portions 45 are capable of pressing right and left side walls of the pressure portion 22 of the terminal 20, respectively accommodated in each cavity 11.

A guide groove 46 open on a ceiling surface of the pressing concave portion 44 is formed in a region, of each pressing concave portion 44, corresponding to the pressure blade 23 of the terminal 20. A pressure tool 48 vertically movable is installed on each guide groove 46. The lower surface of the pressure tool 48 is circular arc-shaped in conformity to the shape of the periphery of the electric wire 35. A pair of front and rear escape grooves 49 for escaping the pressure blade 23 of the terminal 20 is formed on the lower surface of the pressure tool 48. As shown in FIG. 4, the pressure tool 48 is located inside the ceiling surface of the pressing concave portion 44 except when the upper part 41 is operated.

As shown also in FIG. 1 as well, a receiving tool-insertion opening 19 is formed at a rear portion of the bottom surface of each cavity 11 of the housing 10. As shown in FIG. 4, a receiving portion 51 capable of penetrating into each receiving tool-insertion opening 19 is formed on the upper surface of the lower part 42 of the pressure die 40. The uppermost portion of the receiving portion 51 is mountain-shaped in section. When the housing 10 is placed on the lower part 42, the apex of the mountain portion 52 reaches approximately the vertical center of the insertion through-hole 31 of the rubber stopper 30 of the mountain portion 52.

The rear surface of the mountain portion 52 of the receiving portion 51 is gently inclined to form a comparatively gentle slope 53. The foot of the slope 53 is located at a level a little lower than the lower end of the insertion through-hole 31 of the rubber stopper 30. The front surface of the mountain portion 52 is formed as a comparatively steep slope 54. The foot of the slope 54 is located in the vicinity of the bottom surface of the terminal 20.

The operation of the waterproof insulation displacement connector of the first embodiment having the above-described construction will be described below.

As described previously, initially, the terminal 20 is accommodated inside each cavity 11 of the housing 10, and the rubber stopper 30 for all the cavities 11 is installed on the rear surface of the housing 10. Then, as shown in FIG. 4, the housing 10 is placed on the lower part 42 of the pressure die 40, with the receiving tool-insertion opening 19 being coincident with the receiving portion 51. The receiving portion 51 projects upward at a position immediately forward from the rubber stopper 30, with the receiving portion 51 in penetration through the receiving tool-insertion opening 19 and with the apex of the mountain portion 52 located at the vertical center of the insertion through-hole 31.

Then, the upper part 41 of the pressure die 40 moves downward and is inserted into the opening 15 formed on the upper surface of the housing 10, and each pressing concave portion 44 presses the pressure portion 22 of the corresponding terminal 20 from above.

When the setting of the housing 10 is completed, the electric wire 35 is inserted into the insertion through-hole 31 of the rubber stopper 30 from the rear side thereof, as shown with an arrow of FIG. 4. Thereafter, the front end of the electric wire 35 passes the apex of the mountain portion 52 while it is being guided upward along the slope 53 located at the rear side of the mountain portion 52 of the receiving portion 51. Then, the front end of the electric wire 35 proceeds linearly forward along a narrow-width portion of the pressing concave portion 44 located at an upper portion of the pressing concave portion 44. When the front end of the electric wire 35 reaches a portion near the front end of the pressure tool 48, the insertion of the electric wire 35 is stopped (see FIG. 5).

Figure 5:
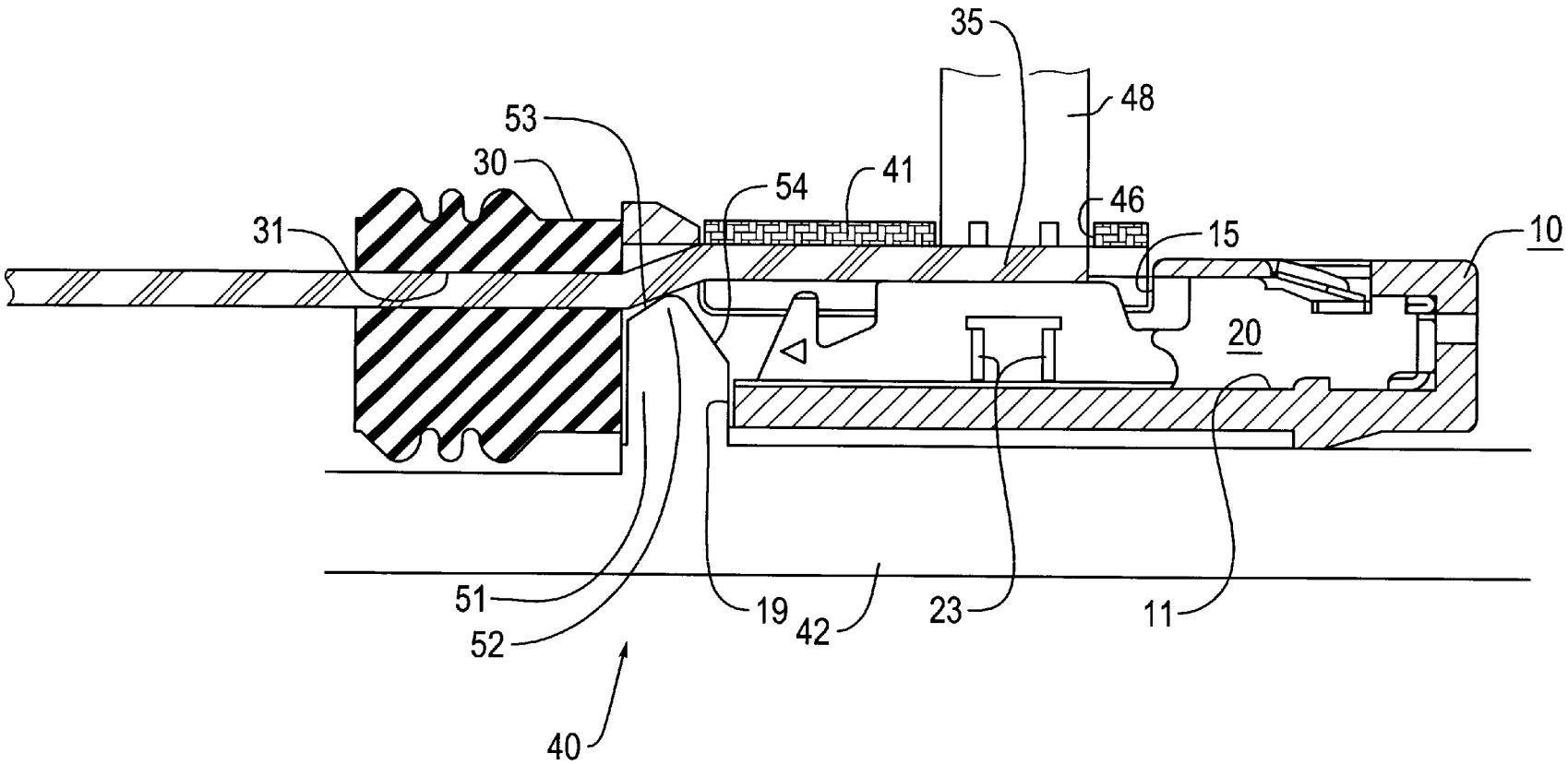
FIG. 5 is a sectional view showing a state in which the insertion of the electric wire is completed.
Figure 6:
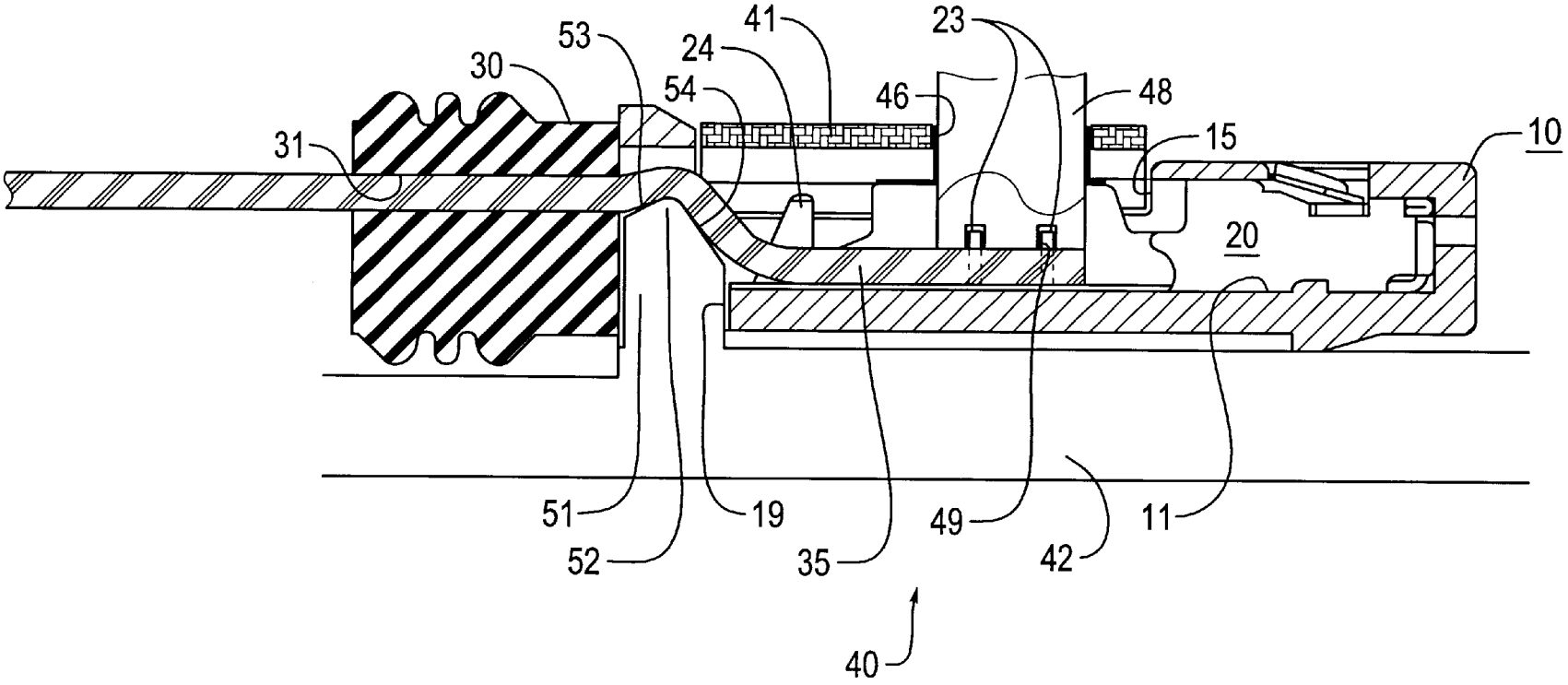
FIG. 6 is a sectional view showing a state in which the electric wire is connected with the pressure-connection terminal.

Then, as shown with a downward arrow of FIG. 5, the pressure tool 48 is moved downward, while the pressure blade 23 of the terminal 20 is being escaped to the escape groove 49. As a result, as shown in FIG. 6, the front end of the electric wire 35 is forced downward to the pressure blade 23 and the electric wire 35 is pressed against the pressure blade 23. Consequently, the electric wire 35 becomes electrically conductive with the terminal 20.

Upon completion of the above pressure-connection process, the pressure tool 48 moves upward to the original position and the entire upper part 41 of the pressure die 40 moves upward, and the housing 10 is removed upward from the lower part 42, while the receiving portion 51 of the lower part 42 is being removed from the receiving tool-insertion opening 19.

Then, the barrel 24 of the terminal 20 is caulked to the electric wire 35, and the opening 15 is closed with a cover 5 (FIG. 2). In this manner, the formation of the housing 10 shown in FIG. 1 is completed. As described previously, the housing 10 is inserted into the housing accommodation chamber 2 of the female-side frame 1 from the rear side thereof, and the rubber stopper 30 installed on the rear surface of the housing 10 is installed on the entrance of the housing accommodation chamber 2.

As described above, in the first embodiment, when the electric wire 35 projecting forward from the rubber stopper 30 is stretched downward in the pressure-connection operation, the root portion of the electric wire 35 is received with the receiving portion 51 of the lower part 42 of the pressure die 40. Thus, the insertion through-hole 31 of the rubber stopper 30 is not subjected to the stretching force. Consequently, the insertion through-hole 31 can be prevented from deforming, which provides sealing performance securely in the periphery of the electric wire 35.

Further, the sealing performance in the periphery of the electric wire 35 can be reliably accomplished by merely forming the receiving tool-insertion opening 19 on the housing 10 and the receiving portion 51 on the lower part 42 of the pressure die 40.

Figure 8:
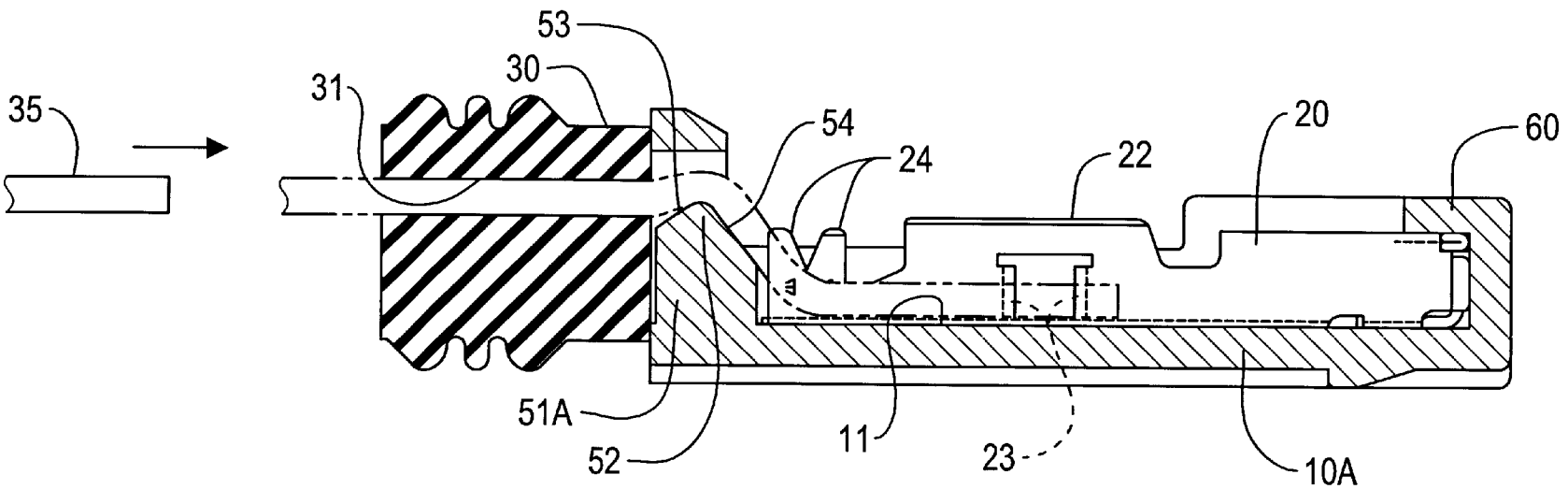
FIG. 8 is a sectional view showing the construction of a housing according to a second embodiment of the present invention.
Figure 9:
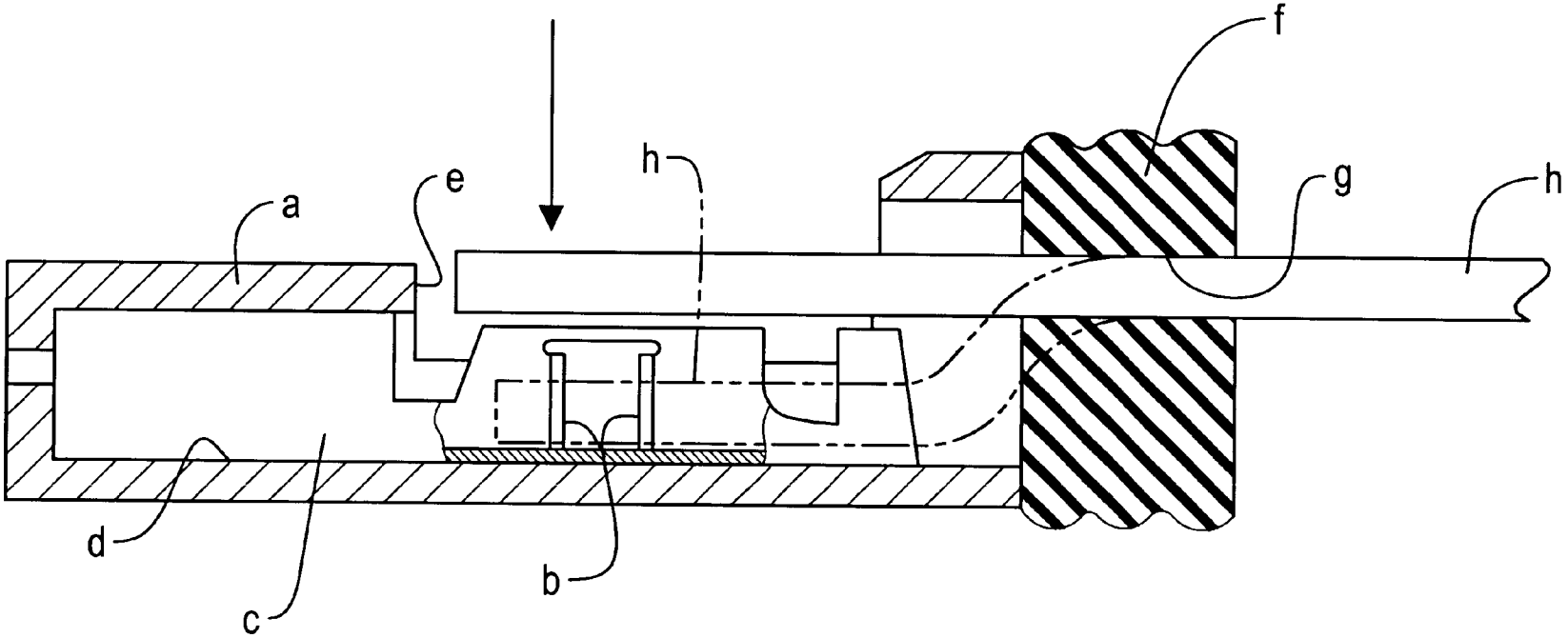
FIG. 9 is a sectional view showing a conventional waterproof insulation displacement connector.

FIG. 8 shows a second embodiment of the present invention. In the second embodiment, a receiving tool (portion) 51A is formed integrally with a housing 10A unlike the first embodiment in which the receiving portion 51 is formed on the lower part 42 of the pressure die 40. The second embodiment is described below by mainly describing different constructions thereof from that of the first embodiment.

A short ceiling wall 60 is formed at the front side of the housing 10A. The receiving portion 51A integral with the cavity 11 is erected upward from the rear end of the bottom surface thereof. The receiving portion 51A has the same shape as that of the receiving portion 51 of the first embodiment. Briefly describing, the mountain portion 52 is formed at the upper end of the receiving portion 51. The apex of the mountain portion 52 is located in the vicinity of the vertical center of the insertion through-hole 31 of the rubber stopper 30. The rear surface of the mountain portion 52 is gently inclined to form a comparatively gentle slope 53. The foot of the slope 53 is located at a level a little lower than the insertion through-hole 31 of the rubber stopper 30. The front surface of the mountain portion 52 is formed as a comparatively steep slope 54.

A pressure-connection work is performed as follows: initially, the terminal 20 is accommodated inside each cavity 11 of the housing 10A. In this case, the terminal 20 is inserted downward into the cavity 11 and pressed forward, with the front side of the terminal 20 slanted downward, and the rubber stopper 30 for all the cavities 11 is installed on the housing 10A at the rear surface thereof.

Then, the housing 10A thus assembled is placed on the lower part of the pressure die. Then, as shown with an arrow of FIG. 8, the electric wire 35 is inserted into the insertion through-hole 31 of the rubber stopper 30 from the rear side thereof. Thereafter, the front end of the electric wire 35 passes the apex of the mountain portion 52 while it is being guided upward along the slope 53 located at the rear side of the mountain portion 52 of the receiving portion 51. When the front end of the electric wire 35 arrives in front of the pressure blade 23, the insertion of the electric wire 35 is stopped.

Then, the pressurizing tool 48 is moved downward. As a result, as shown with two-dot chain lines of FIG. 8, the front end of the electric wire 35 is pressed against the pressure blade 23. Consequently, the electric wire 35 becomes electrically conductive with the terminal 20. When the electric wire 35 projecting forward from the rubber stopper 30 is stretched downward in the pressure-connection operation, the root portion of the electric wire 35 is received with the receiving portion 51 of the lower part 42 of the pressure die 40. Thus, the insertion through-hole 31 of the rubber stopper 30 is not subjected to the stretching force. Consequently, the insertion through-hole 31 can be prevented from deforming, which provides sealing performance in the periphery of the electric wire 35 securely.

In the second embodiment, the receiving portion 51A is formed integrally with the housing 10A. Therefore, it is unnecessary to alter the construction of the pressure-die, which allows the waterproof insulation displacement connector to be manufactured at a low cost.

The present invention is not limited to the embodiments described above with reference to the drawings. For example, embodiments described below are included in the technical scope of the present invention. Further, it is possible to make various modifications of the present invention without departing from the scope of the present invention.

(1) In the first embodiment, it is possible to form the receiving portion for receiving the root portion of the electric wire separately from the lower part 42 and move the receiving portion vertically relative to the lower part 42.

(2) In the above-described embodiments, the housing (10, 10A) that is installed on the frame has been described. But the present invention can be applied to a connector that is used by fitting the housing (10, 10A) and a mating housing in each other without installing the housing (10, 10A) on the frame. In this case, if the housing has a receiving tool-insertion opening similar to the receiving tool-insertion opening 19 of the first embodiment, a cover is proved to close the receiving tool-insertion opening watertightly after a pressure-connection work terminates.

(3) The present invention can be applied to a waterproof insulation displacement connector at a male side.

What is claimed is:

1. A method of manufacturing a waterproof insulation displacement connector, comprising the steps of:

inserting, in a watertight manner, an electric wire into an insertion hole of a rubber stopper;

providing the rubber stopper on a rear surface of a housing that defines a plurality of cavities, each of the plurality of cavities accommodating a pressure-connection terminal and having a pressure connection opening formed on a surface thereof;

inserting the electric wire through the insertion hole of said rubber stopper to place a front end of said electric wire in the vicinity of a front end of said pressure-connection opening, such that the front end of said electric wire is pressed against said pressure-connection terminal to connect said electric wire with said pressure-connection terminal; and projecting, in a direction opposite to a pressure-connection direction, a receiving tool that is provided immediately forward from said rubber stopper to connect said electric wire with said pressure-connection terminal, while said receiving tool is receiving a root portion of said electric wire projecting forward from said rubber stopper.

2. A method of manufacturing a waterproof insulation displacement connector according to claim 1, wherein said receiving tool provided on a pressure die is inserted into said cavity at a position immediately forward from said rubber stopper in a direction opposite to said pressure-connection direction.

3. A method of manufacturing a waterproof insulation displacement connector according to claim 1, wherein a guide portion formed on said receiving tool moves said electric wire inserted through said rubber stopper forward, while said guide portion guides said electric wire in a direction apart from said pressure-connection terminal.

4. A waterproof insulation displacement connector, comprising:

an electric wire having a root portion;

a pressure connection terminal;

a housing that has a rear surface and that defines a plurality of cavities, each of the plurality of cavities accommodating the pressure-connecting terminal, each of the plurality of cavities also having a surface that defines a pressure-connection opening; and a rubber stopper provided on the rear surface of said housing, the rubber stopper defining an insertion hole having an axis and into which the electric wire can be inserted watertightly;

wherein each of the plurality of cavities has another surface that opposes the surface that defines the pressure connection opening, the other surface defining a receiving tool-insertion opening to receive the root portion of said electric wire projecting forward from said rubber stopper such that said receiving tool-insertion opening is located immediately forward from said rubber stopper, and the receiving tool-insertion opening and the pressure connecting opening each has an axis which is substantially perpendicular to the axis of the rubber stopper insertion hole.

5. A waterproof insulation displacement connector according to claim 4, further including a cover that closes said receiving tool-insertion opening.

6. A waterproof insulation displacement connector assembly, comprising:

an electric wire having a root portion;

a pressure connection terminal;

a receiving tool;

a housing that defines a plurality of cavities, each of the plurality of cavities accommodating the pressure-connecting terminal, each of the plurality of cavities also having a surface that defines a pressure-connection opening; and a rubber stopper provided on the rear surface of said housing, the rubber stopper defining an insertion hole into which the electric wire can be inserted water-tightly;

wherein each of the plurality of cavities has another surface that defines the pressure connection opening, the other surface defining a receiving tool that receives a root portion of said electric wire projectingly forward from said rubber stopper such that said receiving tool is located immediately forward from said rubber stopper.

7. A waterproof insulation displacement connector assembly according to claim 6, further including a guide portion, formed on an end of said receiving tool, to forwardly move said electric wire, inserted through said rubber stopper; wherein said guide portion guides said electric wire in a direction apart from said pressure-connection terminal.

* * * * *